US010865998B2

(12) United States Patent
Wang et al.

(10) Patent No.: US 10,865,998 B2
(45) Date of Patent: Dec. 15, 2020

(54) MODULARIZED COMBINED INTELLIGENT HEAT COLLECTOR SYSTEM

(71) Applicants: Chen Wang, Guangdong (CN); Kezheng Wang, Guangdong (CN)

(72) Inventors: Chen Wang, Guangdong (CN); Kezheng Wang, Guangdong (CN)

(73) Assignee: Guangdongsheng Yuchen Electronics & Technology Co., Ltd. (CN)

( * ) Notice: Subject to any disclaimer, the term of this patent is extended or adjusted under 35 U.S.C. 154(b) by 426 days.

(21) Appl. No.: 15/513,137

(22) PCT Filed: Apr. 1, 2016

(86) PCT No.: PCT/CN2016/078337
§ 371 (c)(1),
(2) Date: Mar. 21, 2017

(87) PCT Pub. No.: WO2016/155666
PCT Pub. Date: Oct. 6, 2016

(65) Prior Publication Data

US 2017/0307230 A1 Oct. 26, 2017

(30) Foreign Application Priority Data

Apr. 3, 2015 (CN) ..... 2015 1 0160294

(51) Int. Cl.
*F24D 19/10* (2006.01)
*F24D 3/02* (2006.01)
(Continued)

(52) U.S. Cl.
CPC ..... *F24D 19/1069* (2013.01); *F24D 3/02* (2013.01); *F24D 3/10* (2013.01); *F24D 17/0089* (2013.01);
(Continued)

(58) Field of Classification Search
None
See application file for complete search history.

(56) References Cited

U.S. PATENT DOCUMENTS 2,065,481 A * 12/1936 Thulman ..... F24D 19/1024 237/8 C
2,159,284 A * 5/1939 Miller ..... F24D 19/1066 237/8 R
(Continued)

FOREIGN PATENT DOCUMENTS

WO WO2016/155666 A1 6/2016

*Primary Examiner* — Thor S Campbell

(57) ABSTRACT

A modularized combined intelligent heat collector system, comprising a PTCR-xthm electric heating chip heat source main engine, a data control template, a constant-temperature and constant-pressure device and a variable-frequency pump; the variable-frequency pump and the PTCR-xthm electric heating chip heat source main engine are connected to the data control template; the outlet end of the PTCR-xthm electric heating chip heat source main engine is connected to the constant-temperature and constant-pressure device; the outlet end of the constant-temperature and constant-pressure device is connected to the PTCR-xthm electric heating chip heat source main engine through the variable-frequency pump; the PTCR-xthm electric heating chip heat source main engine directly leads out a user heating pipeline; and/or the PTCR-xthm electric heating chip heat source main engine leads out the user heating pipeline through the constant-temperature and constant-pressure device, and is connected to a heat exchanger of a user water heater.

13 Claims, 3 Drawing Sheets

(51) Int. Cl.

| | |
|---|---|
| ***F24D 3/10*** | (2006.01) |
| ***F24H 9/18*** | (2006.01) |
| ***F24H 1/00*** | (2006.01) |
| ***H05B 3/26*** | (2006.01) |
| ***F24D 17/00*** | (2006.01) |

(52) U.S. Cl.
CPC ..... *F24H 1/0018* (2013.01); *F24H 9/1827* (2013.01); *H05B 3/26* (2013.01); *F24D 2200/29* (2013.01); *F24H 1/009* (2013.01); *H05B 2203/013* (2013.01)

(56) References Cited

U.S. PATENT DOCUMENTS 2,194,691 A * 3/1940 Cornell, Jr. ..... F24D 3/02 237/8 R
2,204,708 A * 6/1940 Smith ..... F24D 3/00 237/8 R
3,240,261 A * 3/1966 Morales ..... F25B 21/02 165/254
4,131,231 A * 12/1978 Cleer, Jr. ..... B23P 15/26 237/8 R
4,143,814 A * 3/1979 Hill, Jr. ..... F24D 11/003 126/610
9,385,574 B1 * 7/2016 Xu ..... F03G 6/005
9,845,998 B2 * 12/2017 Kreuger ..... F28D 15/00
2005/0098643 A1 * 5/2005 Guyer ..... F24D 5/02 237/12.1
2008/0244975 A1 * 10/2008 Johnston ..... B01J 19/249 48/197 FM
2010/0209084 A1 * 8/2010 Nelson ..... F24H 4/04 392/465
2010/0280665 A1 * 11/2010 Fildes ..... F24H 9/2035 700/275
2012/0024240 A1 * 2/2012 Beckley ..... H05B 1/0244 122/14.2
2012/0125029 A1 * 5/2012 Moreau ..... F24D 3/18 62/235.1
2013/0034344 A1 * 2/2013 Lutz ..... F24H 9/128 392/449
2013/0075245 A1 * 3/2013 Frick ..... B01D 1/0047 203/22
2013/0205778 A1 * 8/2013 Hansen ..... F24D 19/1045 60/641.8
2014/0238021 A1 * 8/2014 Harif ..... F01K 15/04 60/653
2014/0368045 A1 * 12/2014 Conry ..... H02J 3/28 307/75
2015/0047378 A1 * 2/2015 Hollingworth ..... F25B 11/00 62/117
2015/0369086 A1 * 12/2015 Johnson ..... F01K 25/10 60/657
2016/0033176 A1 * 2/2016 Zhou ..... F25B 15/02 62/109
2016/0281932 A1 * 9/2016 Karlsson ..... F02M 37/007
2017/0219294 A1 * 8/2017 Longis ..... C09K 5/063

* cited by examiner

MODULARIZED COMBINED INTELLIGENT HEAT COLLECTOR SYSTEM

TECHNICAL FIELD OF THE INVENTION

The present invention relates to the technical field of water and heat (gas) supplying systems for industrial, agricultural and military projects, and more particularly, to a modularized combined intelligent heat collector system.

BACKGROUND OF THE INVENTION

PTCR-xthm electric heating technology, control technology and application technology have rapidly developed in response to the increased emphasis on innovative technologies in the new energy electric heating field. With the development of new intelligent electric heating technologies, high-capacity and multi-functional intelligent heat collectors using a PTCR-xthm electric heating chip as the heat source to supply water and heat (gas) have been widely adopted in the heating systems of ships and agricultural vehicles.

Presently, most of the water and heat (gas) supplying systems for industrial, agricultural, military and civil-use projects, and the heating equipment of the vehicles and ships usually adopt the traditional boilers using fuel coal, gas or oil as the energy sources, which are known to do great harm to the environment and people's health.

Recently, the environment is threatened by increasingly severe smog. Especially, when the new Environment Protection Law, which is called "the strictest in the history", has become effective. It's the first duty for those in science and technology to arouse attention within the tech-field, and promote environmental protection initiatives to fundamentally control the pollution sources and meet the current, unparalleled environmental challenges.

In the 21st century, an internationally advanced heat supplying system is a heat-accumulating electric boiler made in the USA, which is actually a pressure vessel. The heat source adopted in this electric boiler is an electric heating tube, of which the heat efficiency is merely 71% (the heat load of the electric heated tube which is soaked in the boiler is merely 22 w/cm$^2$), and the average lifetime is 1800 hours, resulting in a high maintenance cost. Meanwhile, the boiler is a pressure vessel, which has hidden dangers such as scaling, electric leakage and explosion.

A heat supplying system adopting a photoelectric tube (quartz tube) as the heat radiation source is disclosed in the patent 01134256.0, which utilizes a heating wire to emit light to heat the water in the tube via the heat reflection. Such a design has high heat efficiency, but the structure is too complicated to be maintained. Although it is not a pressure vessel, the temperature of the heat source is very high and the reliability is very low. Consequently, a large-scaled heating unit can easily cause light pollution.

A GeoSpring water heater made in the USA typically represents the heat-pump cycle system (reverse Carnot cycle) of the universally-welcomed air energy water heater. In this arrangement, a small-sized steam pump is equipped to the GeoSpring water heater by GE. The GeoSpring water heater takes in the heat energy in the air, and some of the large-scaled units directly extract the terrestrial heat. The heat dissipation temperature of the heat-pump system is 54° C., failing to satisfy the multi-functional and all-weather serving requirements of the high-capacity water and heat (gas) supplying systems due to the low temperature of the heat source and the high cost of its structure.

In conclusion, the shortcomings of traditional water and heat (gas) supplying systems are urgent problems that need to be solved for those skilled in this field.

SUMMARY OF THE INVENTION

The purpose of the present invention is to solve the shortcomings in the prior art and provide a modularized combined intelligent heat collector system, which does not create any pollution or emission, but is highly efficient, energy saving and safe.

To achieve the above purpose, the present invention adopts the following technical solution:

A modularized combined intelligent heat collector system, comprising a PTCR-xthm electric heating chip heat source main engine, a data control template, a constant-temperature and constant-pressure device and a variable-frequency water pump. The variable-frequency pump and the PTCR-xthm electric heating chip heat source main engine are connected to the data control template. The outlet end of the PTCR-xthm electric heating chip heat source main engine is connected to the constant-temperature and constant-pressure device. The outlet end of the constant-temperature and constant-pressure device is connected to the PTCR-xthm electric heating chip heat source main engine through the variable-frequency water pump.

The PTCR-xthm electric heating chip heat source main engine directly leads out a user heating pipeline for supplying heat to the users.

And/or the PTCR-xthm electric heating chip heat source main engine leads out of the user heating pipeline through the constant-temperature and constant-pressure device, and is connected to the user water heater's heat exchanger.

In another aspect of the present invention, the outlet end of the PTCR-xthm electric heating chip heat source main engine has two branches. One branch is interconnected to the user heating pipeline through a throttle valve and a first stop valve. The user heating pipeline is interconnected to the user heat exchanger and the gas collector, which is located higher than the user heat exchanger. The user heat exchanger is interconnected to the heat source main engine through the first water return pipe, the stop valve and the variable-frequency water pump. The other branch is interconnected to the water inlet pipe of the constant-temperature and constant-pressure device through the throttle valve and the second stop valve. The outlet pipe of the constant-temperature and constant-pressure device is interconnected to the first water return pipe, which is located in front of the variable-frequency water pump through a non-return valve. A T-branch pipe is installed on the water return pipe. One end of the T-branch pipe is connected to an expansion water pipe, and the water level of the expansion water pipe is higher than that of the user heat exchanger.

In another aspect of the present invention, the inlet pipe of the PTCR-xthm electric heating chip heat source main engine is connected to a tap-water or glycol type cooling liquid tank. The outlet pipe of the PTCR-xthm electric heating chip heat source main engine is connected to the inlet pipe of the constant-temperature and constant-pressure device. The constant-temperature and constant-pressure device is provided with a second water return pipe, which is connected to the variable-frequency water pump. The outlet pipe of the variable-frequency pump is connected to the PTCR-xthm electric heating chip heat source main engine. The outlet pipe of the constant-temperature and constant-pressure device is connected to the heat exchanger of the user water heater.

In another aspect of the present invention, the power supply terminal of the PTCR-xthm electric heating chip heat source main engine is connected to the data control template. The data control template is connected to a temperature sensor, which is disposed in an environment where the user heat exchanger is installed.

In another aspect of the present invention, the data control template comprises a microcomputer processing center, which is connected to the temperature sensor and an executive component. The temperature sensor is used to measure the user's indoor temperature. When the actual indoor temperature is different from the set temperature (the heating load varies), the temperature sensor sends an electric feedback signal to the master control center, giving an instruction to the executive component after being processed by the microcomputer processing center. Consequently, the supply voltage and current can be regulated to control the temperature. The working state of the PTCR-xthm electric heating chip heat source module main engine can also be detected by the data control template. The electric heating chip main engine is composed of a plurality of the heat source modules. It is crucially important to monitor the working temperature of the heat source module. When a failure of the variable-frequency water pump or the heating medium cycle system happens, the failure code can be automatically displayed, or an alternate program can be automatically started to self-recover or alarm the recovering process.

In another aspect of the present invention, the microcomputer processing center of the data control module adopts a microprocessor as the key control unit, which is equipped with a computer hardware system, a peripheral multi-channel interface circuit, a computer control circuit, and a temperature sensor closed circuit feedback system. The microcomputer processing center adopts a thermistor or rare-earth thick film temperature-sensitive control circuit.

In another aspect of the present invention, the PTCR-xthm electric heating chip heat source main engine comprises an upper cover plate, a plurality of PTCR-xthm electric heating chip heat source modules, a water inlet end cover and a water outlet end cover. The top of the plurality of PTCR-xthm electric heating chip heat source modules is covered by the upper cover plate. The water inlet end cover and the water outlet end cover are respectively disposed at the end sides of the plurality of PTCR-xthm electric heating chip heat source modules. The water inlet end cover, the water outlet end cover and the electric heating chip heat source modules are respectively provided with a water inlet and outlet channel.

In another aspect of the present invention, the plurality of PTCR-xthm electric heating chip heat source modules are overlapped from top to bottom. An insulation heat-conducting film is disposed between the upper cover plate and the PTCR-xthm electric heating chip heat source module, which is disposed underneath the upper cover plate; and, an insulation heat-conducting film is disposed between two adjacent PTCR-xthm electric heating chip heat source modules.

In another aspect of the present invention, a sealing component is disposed at the point where the water inlet end cover, the water outlet end cover, and the electric heating chip heat source modules are connected to exert a sealing function.

In another aspect of the present invention, the water inlet end cover and the water outlet end cover are metal baseplates or non-metal baseplates. The material of the metal baseplate is rare-earth aluminum alloy, stainless steel, titanium alloy or copper, or one composite material selected from aluminum bronze Cu+, aluminum steel, titanium copper Cu+, or aluminum titanium. The material of the non-metal baseplate is selected from one of the functional ceramics, glass ceramics, quartz glass or silicon resin.

In another aspect of the present invention, the PTCR-xthm electric heating chip heat source module comprises a PTCR-xthm electric heating chip heat source baseplate and a rare-earth thick film circuit disposed on the baseplate.

In another aspect of the present invention, the rare-earth thick film circuit is perpendicularly overlapped on the thick film resistor circuit or horizontally distributed with the thick film resistor circuit in the form of a thick film circuit, which integrates a plurality of layers in one plane or in a plurality of curved planes. The rare-earth thick film circuit in the plane is prepared by silk-screen printing and sintering, and the rare-earth thick film circuit in the curved plane is prepared by tap casting and film bonding/HIP.

In another aspect of the present invention, the heat-accumulating, constant-temperature and constant pressure device is provided with a temperature sensor, a pressure sensor and a safety exhaust valve. The saturated steam temperature of the constant-temperature and constant pressure device is 180° C.

Compared with the prior art, the present invention has the following advantages:

First, the present invention is a high-capacity, multi-functional and intelligent water and heat (gas) supplying heat collector system, adopting the rare-earth thick film circuit electric heating chip (namely, PTCR-xthm electric heating chip) as the heat source. The system comprises a PTCR-xthm electric heating chip heat source main engine, a safe constant-temperature and constant-pressure device for accumulating heat, a data control template, a variable-frequency water pump and an intelligent heating medium cycle management system. The PTCR-xthm electric heating chip heat source main engine consists of N (N is a natural number, which is set according to the system heating load and total power, etc.) electric heating chip heat source modules. Each PTCR-xthm electric heating chip heat source module is provided with a water inlet pipe, a water outlet pipe and a safe constant-temperature and constant-pressure device for accumulating heat. The variable-frequency water pump is connected to the heating medium cycle system, and the water source is heated to a set temperature when flowing through a PTCR-xthm electric heating chip heat source module. The water source can be immediately heated without waiting, which is suitable for water and heat (gas) suppling systems in industrial, agricultural and military projects, heating systems in various warships and agricultural vehicles, as well as water systems in home-use and commercial-use electric appliances.

Second, the present invention is energy-saving. The PTCR-xthm electric heating chip heat source module combines the direct heat source and the water channel. The thermoelectric conversion efficiency of the present invention can achieve 95%, which can save energy and material by 50% than that of the other heat sources.

Third, the present invention is multi-functional. The PTCR-xthm electric heating chip heat source module is cheap, easy to mold, has high heating efficiency, uniform temperature field, and high heating performance, which is applicable for new energies and can be used under high/low pressure and AC/DC power supply. Furthermore, the present invention has high intensity, capacity, integration levels, and temperature for infrared function, which can supply heat, water and gas in all weathers.

Fourth, the present invention is very safe. The heat source module is a heat source similar to a boiler having no inner case. It is a non-pressure vessel, realizing the separation of water and electricity. It has advantages of quick heating response, high heat source utilization level, easy maintenance and reliable operation.

Fifth, the present invention is intelligent and humanized, which is controlled by a microcomputer. It features infrared sensing, stepless frequency conversion, automatic constant-temperature, multi-functional protection, failure feedback system, allowing the present invention to be smoothly and safely operated.

Sixth, the present invention is highly efficient. The modularized combined design has high capacity, small size and low land occupation, which is easy to maintain and highly efficient.

BRIEF DESCRIPTION OF THE DRAWINGS

To clearly expound the present invention or technical solution, the drawings and embodiments are hereinafter combined to illustrate the present invention. Obviously, the drawings are merely some embodiments of the present invention and those skilled in the art can associate themselves with other drawings without paying creative labor.

MARKING INSTRUCTIONS OF THE DRAWINGS

1, PTCR-xthm Electric Heating Chip Heat Source Main Engine 1-1, Upper Cover Plate 1-2, PTCR-xthm Electric Heating Chip Heat Source Module 1-21, PTCR-xthm Electric Heating Chip Heat Source Baseplate 1-22, Rare-earth Thick Film Circuit 1-3, Water Inlet End Cover 1-4, Water Outlet End Cover 1-5, Water Inlet and Outlet Channel 1-6, Insulation Heat-conducting Film 1-7, Sealing Component 2, Data Control Template 3, Constant-temperature and Constant-pressure Device 4, Variable-frequency Water Pump 5, Heat Exchanger 6, Gas Collector 7, Water Return Pipe 8, Stop Valve 9, Throttle Valve 10, Stop Valve 11, Non-return Valve 12, Expansion Water Pipe 13, Inlet Pipe 14, Tap-water or Glycol Type Cooling Liquid Tank 15, Outlet Pipe 16, Outlet Pipe 17, Heat Exchanger 18, Stop Valve.

DETAILED DESCRIPTION OF THE INVENTION

Drawings and detailed embodiments are combined hereinafter to elaborate the technical principles of the present invention.

The present invention is a modularized combined intelligent heat collector system, which comprises a PTCR-xthm electric heating chip heat source main engine 1, a data control template 2, a constant-temperature and constant-pressure device 3 and a variable-frequency water pump 4. The variable-frequency pump 4 and the PTCR-xthm electric heating chip heat source main engine 1 are connected to the data control template 2. The outlet end of the PTCR-xthm electric heating chip heat source main engine 1 is connected to the constant-temperature and constant-pressure device 3. The outlet end of the constant-temperature and constant-pressure device 3 is connected to the PTCR-xthm electric heating chip heat source main engine 1 through the variable-frequency water pump 4. The PTCR-xthm electric heating chip heat source main engine 1 consists of N (N is a natural number, which is set according to the system heating load and total power, etc.) electric heating chip heat source modules. The PTCR-xthm electric heating chip heat source main engine 1 is sequentially connected to other parts according to FIGS. 1-3.

Figure 1:
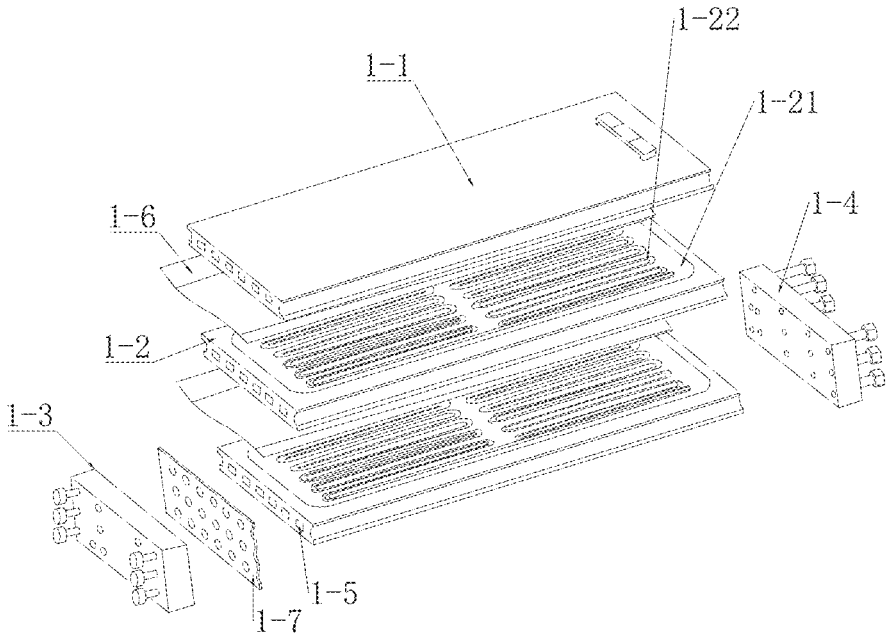
FIG. 1 is a structure diagram of the PTCR-xthm electric heating chip heat source module of the present invention.

As shown in FIG. 1, the PTCR-xthm electric heating chip heat source main engine 1 comprises an upper cover plate 1-1, a plurality of PTCR-xthm electric heating chip heat source modules 1-2, a water inlet end cover 1-3 and a water outlet end cover 1-4. The top of the plurality of PTCR-xthm electric heating chip heat source modules 1-2 is covered by the upper cover plate 1-1. The water inlet end cover 1-3 and the water outlet end cover 1-4 are respectively disposed at the end sides of the plurality of PTCR-xthm electric heating chip heat source modules 1-2. The water inlet end cover 1-3, the water outlet end cover 1-4 and the electric heating chip heat source modules 1-2 are respectively provided with a water inlet and outlet channel 1-5. The plurality of PTCR-xthm electric heating chip heat source modules 1-2 are overlapped from top to bottom. An insulation heat-conducting film 1-6 is disposed between the upper cover plate 1-1 and the PTCR-xthm electric heating chip heat source module 1-2, which is disposed underneath the upper cover plate, and an insulation heat-conducting film 1-6 is disposed between two adjacent PTCR-xthm electric heating chip heat source modules 1-2. A sealing component 1-7 is disposed at the point where the water inlet end cover 1-3, the water outlet end cover 1-4, and the electric heating chip heat source modules 1-2 are connected to exert a sealing function. The water inlet end cover 1-3 and the water outlet end cover 1-4 are metal baseplates or non-metal baseplates. The material of the metal baseplate is rare-earth aluminum alloy, stainless steel, titanium alloy or copper, or one composite material selected from aluminum bronze Cu+, aluminum steel, titanium copper Cu+, or aluminum titanium. The material of the non-metal baseplate is selected from one of the functional ceramics, glass ceramics, quartz glass or silicon resin. The PTCR-xthm electric heating chip heat source module 1-2 comprises a PTCR-xthm electric heating chip heat source baseplate 1-21 and a rare-earth thick film circuit disposed on the baseplate 1-22. The rare-earth thick film circuit 1-22 is perpendicularly overlapped on the thick film resistor circuit or horizontally distributed with the thick film resistor circuit in the form of a thick film circuit, which integrates a plurality of layers in one plane or in a plurality of curved planes. The rare-earth thick film circuit in the plane is prepared by silk-screen printing and sintering, and the rare-earth thick film circuit in the curved plane is prepared by tap casting and film bonding/HIP.

Figure 2:
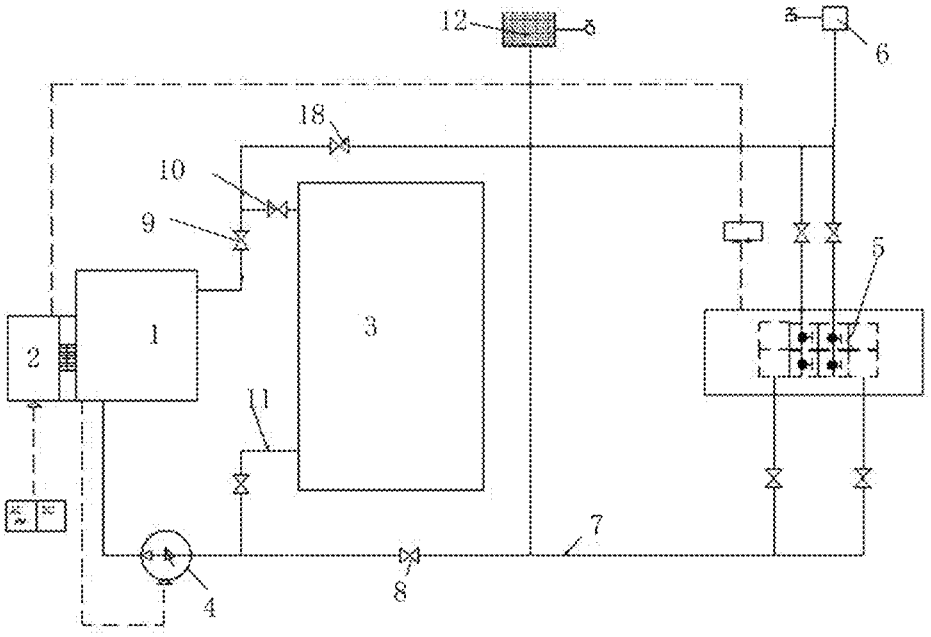
FIG. 2 is a schematic diagram illustrating the heating structure of the heat collector system of the present invention.

As shown in FIG. 2, the modularized combined intelligent heat collector system comprises a data control template 2, a variable-frequency water pump 4 and a heating medium cycle intelligent management system. Specifically, the outlet end of the PTCR-xthm electric heating chip heat source main engine 1 has two branches. One branch is interconnected to the user heating pipeline through a throttle valve 9 and a first stop valve 18. The user heating pipeline is interconnected to the user heat exchanger 5 and the gas collector 6, which is located higher than the user heat exchanger 5. The user heat exchanger 5 is interconnected to the heat source main engine through the first water return pipe 7, the stop valve 8 and the variable-frequency water pump 4. The other branch is interconnected to the water inlet pipe of the constant-temperature and constant-pressure device 3 through the throttle valve 9 and the second stop valve 10. The outlet pipe of the constant-temperature and constant-pressure device 3 is interconnected to the first water return pipe 7, which is located in front of the variable-frequency water pump 4, through a non-return valve 11. The water return pipe is connected to an expansion water pipe 12 through a T-branch pipe, and the water level of the expansion water pipe 12 is higher than that of the user heat exchanger 5. The power supply terminal (socket) of the heat supplying main engine is connected to the data control template 2 through a plug, and the data control template 2 is connected to a temperature sensor, which is disposed in an environment where the heat exchanger is installed.

The constant-temperature and constant-pressure device operates under the normal pressure, which is equipped with a water level indicator, a safety exhaust valve and a sensing device. The highest temperature working point is 180° C. The PTCR-xthm electric heating chip heat source main engine, the regulating valve, the constant-temperature and constant-pressure device, and the variable-frequency water pump form a circulation loop. The heating medium in the constant-temperature and constant-pressure device is conveyed to the PTCR-xthm electric heating chip heat source main engine, which returns to the constant-temperature and constant-pressure device after being heated to complete a heating cycle. The temperature of the cycle heating medium is raised by 25-30° C. every time. When the temperature of the heating medium in the constant-temperature and constant-pressure device reaches the set value, the inlet valve of the constant-temperature and constant-pressure device can be closed to allow the heating medium to directly enter into the user heating cycle system. The difference between the water supplying temperature and the water return temperature of an ordinary user cycle system is 25-30° C.

The data control template 2 comprises a temperature sensor, a microcomputer processing center, which is connected to the temperature sensor, and an executive component. The temperature sensor measures the user's indoor temperature. When the actual indoor temperature is different from the set temperature (the heating load varies), the temperature sensor sends a feedback signal to the master control center, and gives an instruction to the executive component (solid-state voltage regulator) after being processed by the microcomputer processing center. Consequently, the supply voltage and current can be regulated to control the temperature. The working state of the PTCR-xthm electric heating chip heat source module main engine 1 can also be detected by the data control template 2. The electric heating chip main engine is composed of a plurality of the heat source modules. It is very important to monitor the working temperature of the heat source module. When a failure of the variable-frequency water pump or the heating medium cycle system occurs, the failure code can be automatically displayed, or an alternate program can be automatically started to self-recover or initiate the recovering process.

Moreover, the data control template 2 adopts a microcomputer control system. The microcomputer processing center of the data control module adopts a microprocessor as the key control unit, which is equipped with a computer hardware system, a peripheral multi-channel interface circuit, a computer control circuit, and a temperature sensor closed circuit feedback system. The microcomputer processing center adopts a thermistor or rare-earth thick film temperature-sensitive control circuit. The detailed description is omitted herein.

Figure 3:
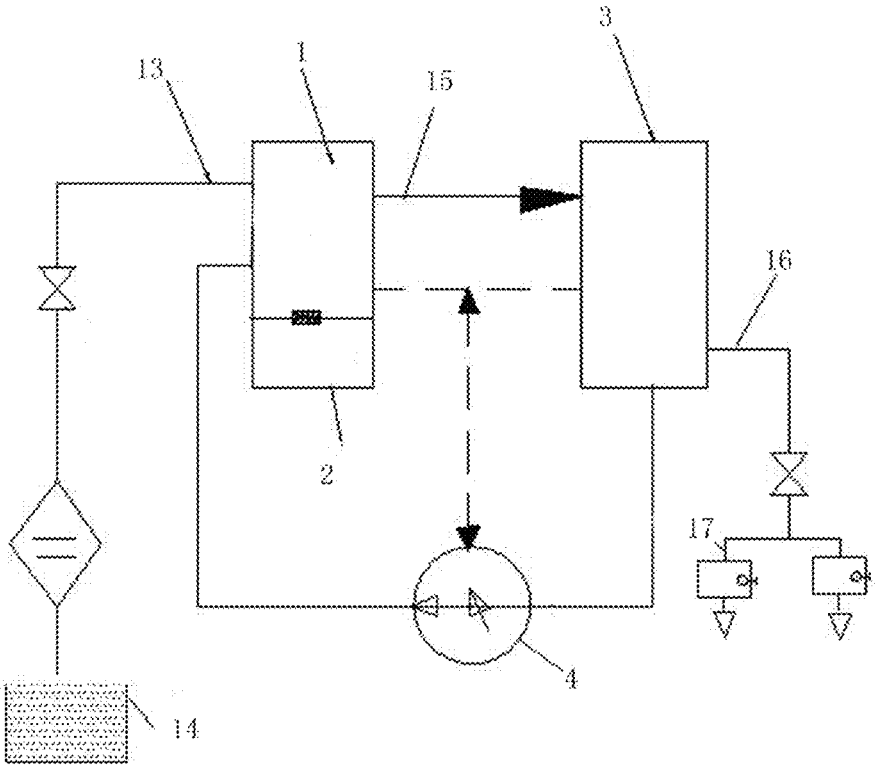
FIG. 3 is a schematic diagram illustrating a structure example of the water heater.

As shown in FIG. 3, the structure of the heating medium cycle pipeline system is the following: the inlet pipe 13 of the PTCR-xthm electric heating chip heat source main engine 1 is connected to the tap water or glycol type cooling liquid tank 14; the outlet pipe 15 is connected to the inlet pipe of the constant-temperature and constant-pressure device 3; the constant-temperature and constant-pressure device 3 is provided with the water return pipe 14, which is connected to the variable-frequency water pump 4; the outlet pipe of the variable-frequency water pump 4 is connected to the PTCR-xthm electric heating chip heat source main engine 1; the variable-frequency water pump and the terminal socket/plug of the heating modules of the PTCR-xthm electric heating chip heat source main engine 1 are connected to the data control template. The outlet pipe 16 of the constant-temperature and constant-pressure device is connected to the heat exchanger 17 of the user water heater, such as a pipeline machine, a spray head or a vehicle-used heat exchanger, etc.

Another cycle mode is the following: the source water enters into the heat source main engine through the pipeline then enters into the constant-temperature and constant-pressure device after being heated; when the water temperature has not reached the set value, the valve door is closed, and the variable-frequency water pump is automatically controlled by the control template, which allows the water in the constant-temperature and constant-pressure device to enter into the heat source main engine through the water return pipe and the variable-frequency water pump so as to be reheated; After being heated to the set temperature, the water enters into the constant-temperature and constant-pressure device, which can be provided to the users via a pipeline machine, a spray head or a vehicle-used heat exchanger, etc.

The above system can also be used in the heaters of the vehicles, ships or electric cars. The system is closed when used in the heaters of the vehicles and ships. The user can adopt a vehicle-used circulating pump, and change the constant-temperature and constant-pressure device (tank) into a liquid storage tank. The outlet pipe of the liquid storage tank is connected to a heat sink, and the water return pipe of the heat sink is connected to the inlet pipe of the glycol type cooling liquid tank. All of the components must be vehicle-used, and the medium is preferred to be glycol-type cooling liquid. The heating medium is required to have high efficiency, low viscosity, high mobility, mildew prevention, scale prevention and boiling prevention.

DETAILED EMBODIMENT

According to the above cycle system, a 20 KW water and heat supplying equipment used for a small-scaled commercial use residence can adopt one set of the PTCR-xthm electric heating chip modularized combined intelligent heat collector system, and twelve indoor heat exchangers. The circulating water enters into the indoor heat exchanger through the PTCR-xthm electric heating chip heat source module. The temperature of the heating medium is raised by 30° C., and the flow quantity is 5501/h. According to the territorial heat supplying standard that the indoor average temperature is 18° C. and the outdoor lowest temperature is −18° C., the system can supply heat to an area of about 380 square meters.

Note of the Embodiment

This embodiment adopts a porous connection terminal, and the ports can be increased after being modularized and combined. Preferably, the patch cord terminal of the airborne electric apparatus is adopted, or an exclusive-use patch cord terminal is designed to meet the requirements of safety and reliability. The temperature zones and the functions of the PTCR-xthm electric heating chip modularized combined intelligent heat collector system can be customized according to the requirements.

The present invention is applicable to new energy sources (solar energy, wind energy, high energy storage battery and intelligent power grids), and can be used under high/low pressure and AC/DC power supply. It produces zero pollution, zero emission, high efficiency, high reliability, high performance cost ratio, small size, low cost and intelligent control. It is also suitable for water and heat (gas) suppling systems in industrial, agricultural and military projects, heating systems in various warships and agricultural vehicles, and water systems in home-use and commercial-use electric appliances.

TABLE 1

Comparison Table of the Performance Parameters of Several Kinds of Heat Sources

| Heat Source | Photoelectric Tube | Electrical Heated Tube | Gas | PTCR-xthm Electrical Heating Chip | Remark |
|---|---|---|---|---|---|
| Heating Type | quartz tube + reflective concentrator + water pipe | resistance wire + insulation tube + boiler | burner + boiler | direct heat source + water channel | |
| Thermal Properties | indirect heat source | local direct heat source | local direct heat source | direct heat source | |
| Surface Heating Load W/cm$^2$ | 15 w | 20 w | 36 w | 230 w | |
| Heat Response | thermal inertia, comparatively slow | thermal inertia, slow | Instantaneous hot, comparatively quick | 250° C./S, very quick | |
| Electric Heat Effect | 75% | 70% | 48% | above 95% | |
| Volume | middle | large | large | Small, modularized combination | |
| Heat Capacity | middle, small | small, middle | large, middle | large, middle, small | |
| Type of Heat Source | optical radiation heat source | inertia heat source | fuel gas heat source | far infrared heat source | |
| Environment Assessment | local light pollution | zero pollution | pollution | zero pollution | |
| Properties | patent 01134256.0 | U.S.A. heat accumulating electric boiler | gas-fired boiler | "intelligent boiler having no inner case" of the present invention | |

TABLE 2

Comparison between the Present Invention and The U.S.A. Heat Accumulating Electric Boiler

| Power kw | Temperature Rise 25° C. | Flow Quantity (L/h) | Heating Area (m$^2$) | Annual Operating Cost (CNY/m$^2$) | Remark |
|---|---|---|---|---|---|
| 3 | U.S.A Electric Boiler | 68 | 40 | 28.3 | |
| | PTCR-xthm Electric Heating Module | 89 | 63 | 20.10 | |
| 30 | U.S.A Electric Boiler | 708 | 410 | 27.6 | |
| | PTCR-xthm Electric Heating Module | 887 | 530 | 22.1 | |
| 216 | U.S.A Electric Boiler | 5080 | 2971 | 27.43 | |
| | PTCR-xthm Electric Heating Module | 6330 | 3699 | 22.06 | |
| 360 | U.S.A Electric Boiler | 8467 | 4980 | 27.27 | |
| | PTCR-xthm Electric Heating Module | 10688 | 6200 | 21.86 | |
| 540 | U.S.A Electric Boiler | 12700 | 7471 | 27.27 | |
| | PTCR-xthm Electric Heating Module | 15889 | 9389 | 21.86 | |

Note:

1. The heat supplying standard in Beijing is 70 W/m$^2$; the indoor temperature is 18° C. and the lowest outdoor temperature is −16° C.; the heat supplying period is 120 days; the daily heat supplying is 8 hours; the electric charge is calculated by 0.393 CNY/kw·h.
2. The analog data of the industrial standard in Bejing and Tianjing area is referenced.

The high capacity, multi-functional and intelligent water and heat (gas) supplying heat collector system using the PTCR-xthm electric heating chip heat source module as the heat source of the present invention is a pioneering technology.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A modularized combined intelligent heat collector system, comprising:

a electric heating chip heat source main engine, a data control template, a constant-temperature and constant-pressure device, and a variable-frequency water pump, wherein the variable-frequency pump and the electric heating chip heat source main engine are connected to the data control template, wherein the outlet end of the electric heating chip heat source main engine is connected to the constant-temperature and constant-pressure device, wherein the outlet end of the constant-temperature and constant-pressure device is connected to the electric heating chip heat source main engine through the variable-frequency water pump, wherein the electric heating chip heat source main engine directly leads out of a user heating pipeline for supplying heat to the users, wherein and/or the electric heating chip heat source main engine leads out the user heating pipeline through the constant-temperature and constant-pressure device, and is connected to a heat exchanger of a user water heater, wherein the outlet end of the electric heating chip heat source main engine has two branches, wherein one branch is interconnected to the user heating pipeline through a throttle valve and a first stop valve, wherein the user heating pipeline is interconnected to the user heat exchanger and the gas collector which is located higher than the user heat exchanger, wherein the user heat exchanger is interconnected to the heat source main engine through the first water return pipe, the stop valve and the variable-frequency water pump, wherein the other branch is interconnected to the water inlet pipe of the constant-temperature and constant-pressure device through the throttle valve and the second stop valve, wherein the outlet pipe of the constant-temperature and constant-pressure device is interconnected to the first water return pipe which is located in front of the variable-frequency water pump through a non-return valve, wherein a T-branch pipe is installed on the water return pipe, wherein one end of the T-branch pipe is connected to an expansion water pipe, and the water level of the expansion water pipe is higher than that of the user heat exchanger.

2. The modularized combined intelligent heat collector system of claim 1, wherein the inlet pipe of the electric heating chip heat source main engine is connected to a tap-water or glycol type cooling liquid tank, wherein the outlet pipe of the electric heating chip heat source main engine is connected to the inlet pipe of the constant-temperature and constant-pressure device, wherein the constant-temperature and constant-pressure device is provided with a second water return pipe which is connected to the variable-frequency water pump, wherein the outlet pipe of the variable-frequency pump is connected to the electric heating chip heat source main engine, wherein the outlet pipe of the constant-temperature and constant-pressure device is connected to the heat exchanger of the user water heater.

3. The modularized combined intelligent heat collector system of claim 1, wherein the power supply terminal of the electric heating chip heat source main engine is connected to the data control template, wherein the data control template is connected to a temperature sensor which is disposed in an environment where the user heat exchanger is installed.

4. The modularized combined intelligent heat collector system of claim 1, wherein the data control template comprises:

a microcomputer processing center which is connected to the temperature sensor, and an executive component, wherein the temperature sensor is used to measure the user's indoor temperature, wherein when the actual indoor temperature is different from the set temperature, namely, the heating load varies, the temperature sensor feedbacks an electric signal to the master control center, and gives an instruction to the executive component after being processed by the microcomputer processing center so that the supply voltage and current can be regulated to control the temperature.

5. The modularized combined intelligent heat collector system of claim 1, wherein the microcomputer processing center of the data control module adopts a microprocessor as the key control unit, which is equipped with a computer hardware system, a peripheral multi-channel interface circuit, a computer control circuit, and a temperature sensor closed circuit feedback system, wherein the microcomputer processing center adopts a thermistor or rare-earth thick film temperature-sensitive control circuit.

6. The modularized combined intelligent heat collector system of claim 1, wherein the electric heating chip heat source main engine comprises:

an upper cover plate, a plurality of electric heating chip heat source modules, a water inlet end cover, and a water outlet end cover, wherein the top of the plurality of electric heating chip heat source modules is covered by the upper cover plate, wherein the water inlet end cover and the water outlet end cover are respectively disposed at the end sides of the plurality of electric heating chip heat source modules, wherein the water inlet end cover, the water outlet end cover and the electric heating chip heat source modules are respectively provided with a water inlet and outlet channel.

7. The modularized combined intelligent heat collector system of claim 6, wherein the plurality of electric heating chip heat source modules are overlapped from top to bottom, wherein an insulation heat-conducting film is disposed between the upper cover plate and the electric heating chip heat source module, which is disposed underneath the upper cover plate, and an insulation heat-conducting film is disposed between two adjacent electric heating chip heat source modules.

8. The modularized combined intelligent heat collector system of claim 6, wherein a sealing component is disposed at the point where the water inlet end cover, the water outlet end cover, and the electric heating chip heat source modules are connected to exert a sealing function.

9. The modularized combined intelligent heat collector system of claim 6, wherein the water inlet end cover and the water outlet end cover are metal baseplates or non-metal baseplates, wherein the material of the metal baseplate is rare-earth aluminum alloy, stainless steel, titanium alloy or copper, or one composite material selected from aluminum bronze Cu+, aluminum steel, titanium copper Cu+, or aluminum titanium, wherein the material of the non-metal baseplate is selected from one of the functional ceramics, glass ceramics, quartz glass or silicon resin.

10. The modularized combined intelligent heat collector system of claim 6, wherein the electric heating chip heat source module comprises:

a electric heating chip heat source baseplate, and a rare-earth thick film circuit disposed on the baseplate, wherein the rare-earth thick film circuit is perpendicularly overlapped on the thick film resistor circuit or horizontally distributed with the thick film resistor circuit in the form of a thick film circuit, which integrates a plurality of layers in one plane or in a plurality of curved planes, wherein the rare-earth thick film circuit in the plane is prepared by silk-screen printing and sintering, and the rare-earth thick film circuit in the curved plane is prepared by tap casting and film bonding/HIP.

11. The modularized combined intelligent heat collector system of claim 1, wherein the constant-temperature and constant pressure device for accumulating heat is provided with a temperature sensor, a pressure sensor and a safety exhaust valve, wherein the saturated steam temperature of the constant-temperature and constant pressure device for accumulating heat is 180° C.

12. The modularized combined intelligent heat collector system of claim 2 wherein the power supply terminal of the electric heating chip heat source main engine is connected to the data control template, wherein the data control template is connected to a temperature sensor which is disposed in an environment where the user heat exchanger is installed.

13. The modularized combined intelligent heat collector system of claim 4, wherein the microcomputer processing center of the data control module adopts a microprocessor as the key control unit, which is equipped with a computer hardware system, a peripheral multi-channel interface circuit, a computer control circuit, and a temperature sensor closed circuit feedback system, wherein the microcomputer processing center adopts a thermistor or rare-earth thick film temperature-sensitive control circuit.

* * * * *